United States Patent [19]

Durrum

[11] 4,365,943

[45] Dec. 28, 1982

[54] MULTICHANNEL PUMP

[75] Inventor: Emmett L. Durrum, Menlo Park, Calif.

[73] Assignee: Eldex Laboratories, Inc., Menlo Park, Calif.

[21] Appl. No.: 219,421

[22] Filed: Dec. 22, 1980

Related U.S. Application Data

[63] Continuation-in-part of Ser. No. 27,877, Apr. 6, 1979, abandoned.

[51] Int. Cl.[3] ..... F04B 23/04; F04B 43/08

[52] U.S. Cl. ..... 417/429; 417/478

[58] Field of Search ..... 417/426, 429, 474, 475, 417/476, 477, 478, 479

[56] References Cited

U.S. PATENT DOCUMENTS

| | | | |
|---|---|---|---|
| 2,285,974 | 6/1942 | Huber | 417/475 |
| 2,562,552 | 7/1951 | Henry | 417/478 X |
| 3,127,845 | 4/1964 | Voelcker | 417/478 |

FOREIGN PATENT DOCUMENTS

| | | | |
|---|---|---|---|
| 1910436 | 9/1970 | Fed. Rep. of Germany | 417/478 |
| 829329 | 3/1960 | United Kingdom | 417/474 |

*Primary Examiner*—Leonard E. Smith
*Attorney, Agent, or Firm*—Thomas H. Olson

[57] ABSTRACT

A multichannel pump wherein the flow rate through each channel can be independently adjusted. In one embodiment there is a frame composed of upper and lower disc-shaped members which support a shaft in the center and a plurality of tube holders around the periphery. An eccentric cam is carried on the shaft and sequentially contacts resiliently deformable tubes in the respective tube holders. Each tube holder is independently adjustable toward and away from the path of travel of the cam and each can be removed for replacement or repair without affecting operation of the remainder of the apparatus. Also included are structures permitting the use of tubing having a low degree of elasticity, such as Teflon and the like. In another embodiment there is one or more cassette-like pumping units each of which contains two independently adjustable channels. The cassette-like units are so constructed that any reasonable number of the units can be combined to provide a multichannel pump having as many channels as needed.

14 Claims, 12 Drawing Figures

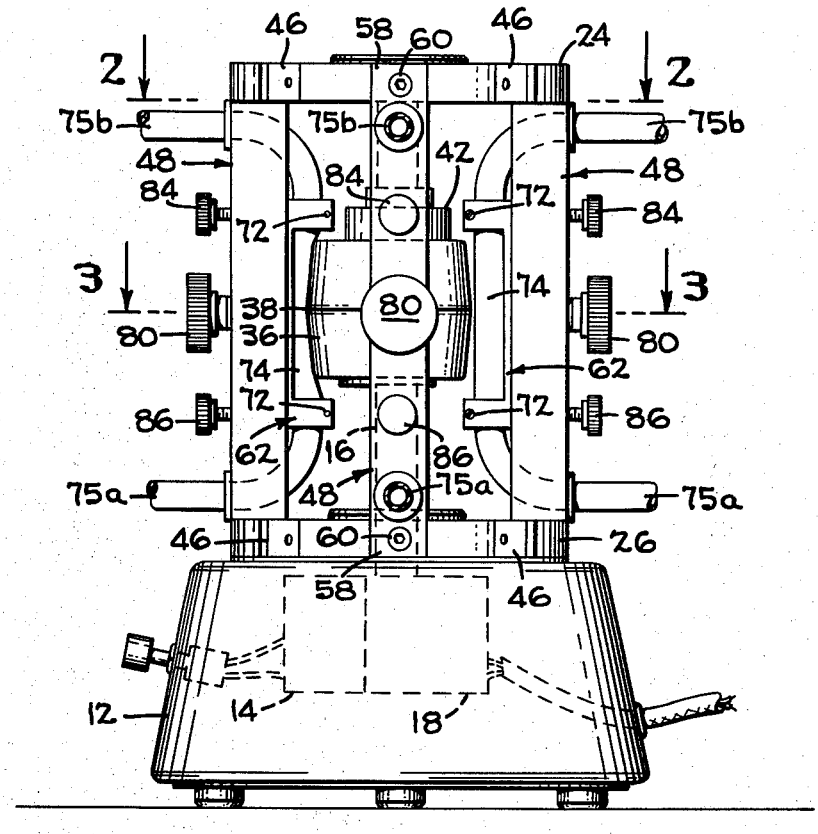
Fig-1
Fig-2
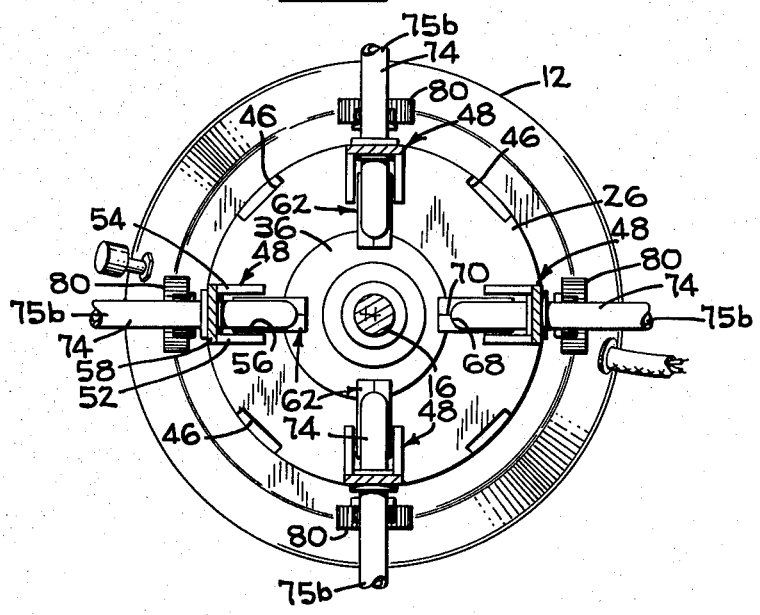

Fig-3
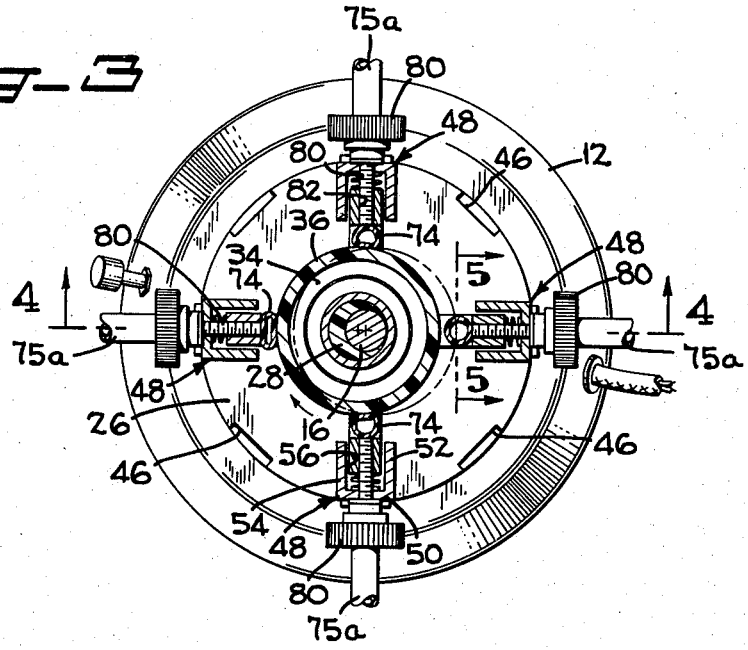
Fig-4
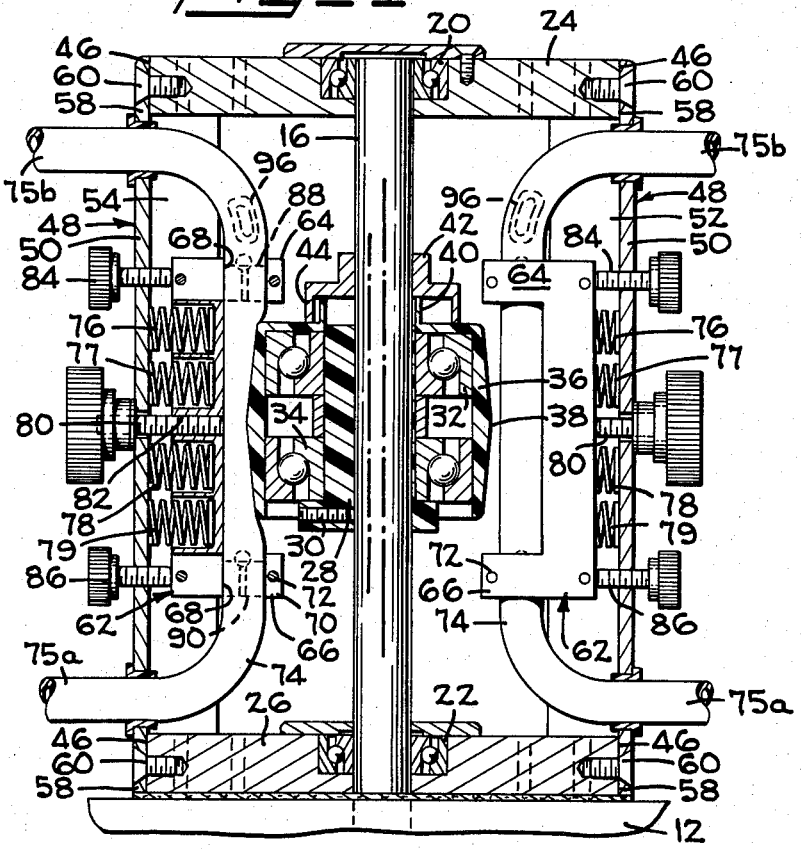
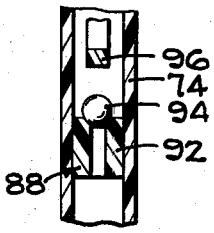
Fig-5

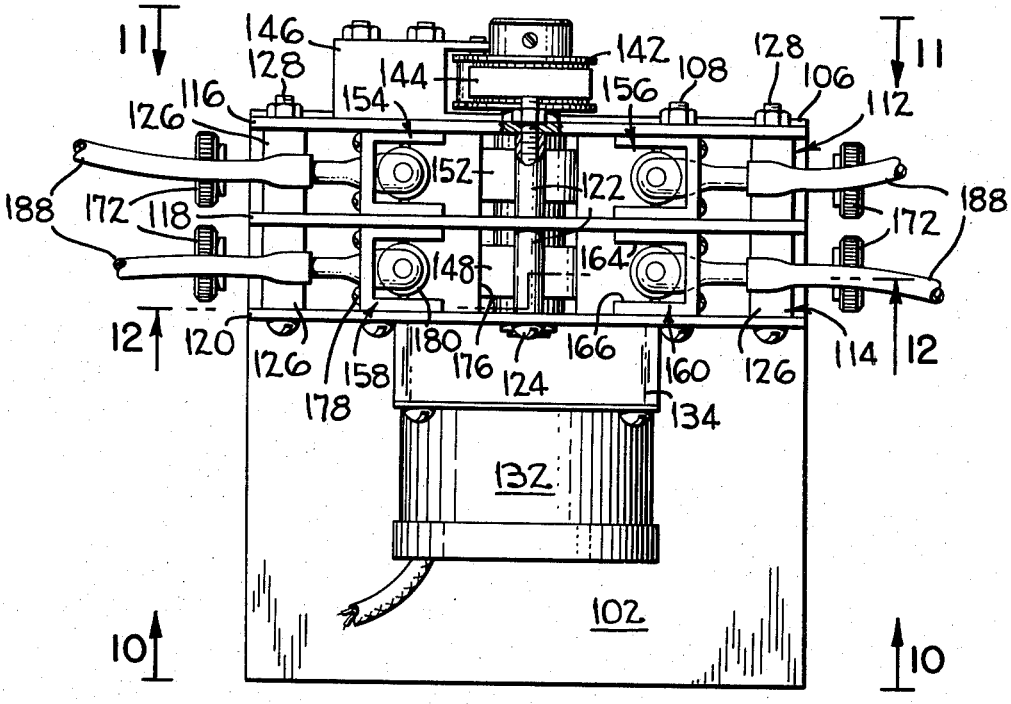
Fig-9
Fig-10
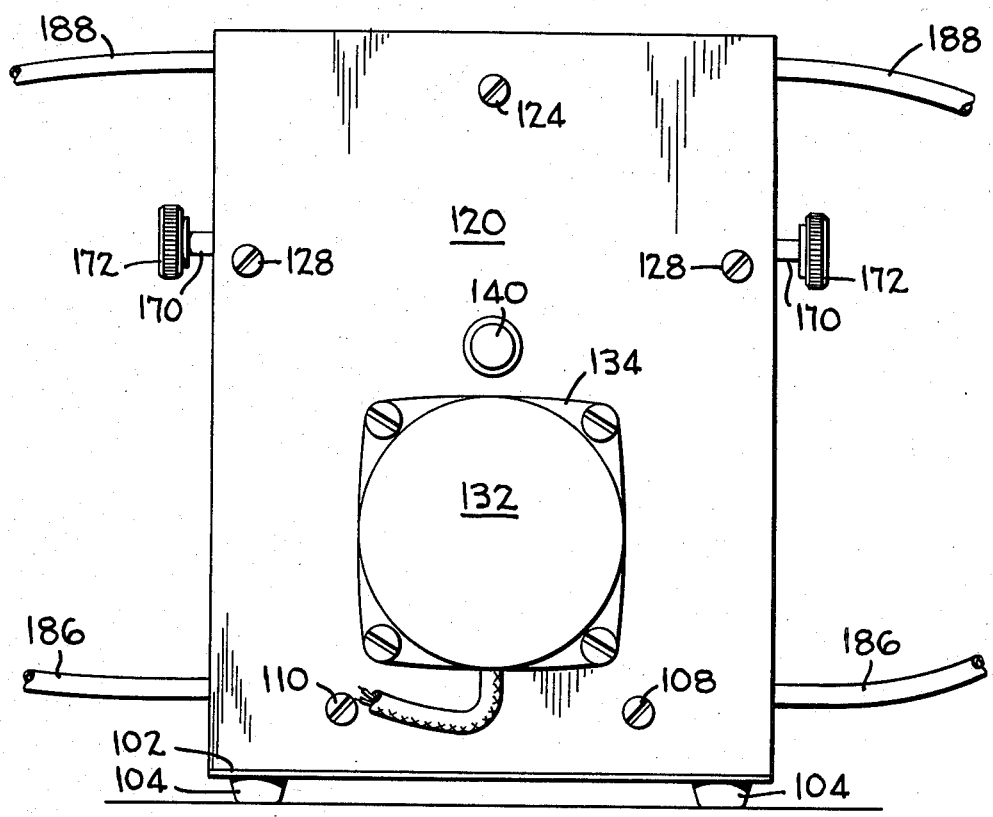

MULTICHANNEL PUMP

CROSS-REFERENCE TO RELATED APPLICATION

This is a continuation-in-part of U.S. application for patent, Ser. No. 27,877, filed Apr. 6, 1979, now abandoned.

BACKGROUND OF THE INVENTION

1. Field of the Invention

This invention relates to a multichannel pump and more particularly to a multichannel pump wherein the pumping rate through each channel is individually adjustable, independently of the pumping rate through all other channels.

2. Description of the Prior Art

U.S. Pat. No. 1,922,196 to Butler discloses a pump having two diametrically mounted tubes which are deformed in wavelike fashion to pump fluid therethrough. The device includes plural cams to induce the wavelike action and has no inlet or outlet valves.

U.S. Pat. No. 2,285,974 to Huber discloses a deformable tube and plural cams which both deform the tube and open and close opposite ends of the tube in synchronism with such deformation.

U.S. Pat. No. 2,922,379 to Schultz discloses a pump having plural tubes arranged in a linear pattern. Flow through the tubes can be adjusted individually by the provision of wedge shaped members associated with each of the tubes. There is an eccentric cam associated with each of the tubes for valving opposite ends of the tube and for deforming central portions of the tube.

U.S. Pat. No. 3,127,845 to Voelcker discloses a pump having an eccentric ball bearing cam for alternately compressing and expanding a resilient elastomeric tube equipped with inlet and outlet check valves. No mechanism for adjusting the relative position of the cam and the resilient tube is disclosed, and accordingly, no adjustment of flow rate through the pump is afforded by the patented pump.

U.S. Pat. No. 3,340,817 to Kemnitz discloses a pump having a plurality of tubes arranged on the interior surface of a frusto conical housing. A rotor having helical flights thereon is supported for rotation in the housing. The rate of flow through all of the tubes is adjustable simultaneously by adjusting the axial position of the housing with respect to the rotor.

U.S. Pat. No. 3,431,864 to Jones discloses a peristaltic pump having a plurality of tubes supported on arcuate paths. The tubes are progressively deformed by rollers that travel on a path concentric to the arcuate configuration of the tubes. The tubes are backed by arcuate platens; different sized platens produce different pumping rates through the respective tubes.

U.S. Pat. No. 3,687,580 discloses a pump wherein a deformable tube is constrained to an arcuate configuration extending over approximately 300°. An eccentric rotor deforms the tube in a wavelike manner.

U.S. Pat. No. 3,791,777 to Papoff et al. discloses a pump wherein deformable tubes are supported on an arcuate path and wherein a rotating member carrying rollers moves along the path to deform the tube in a wavelike manner.

U.S. Pat. No. 4,025,241 to Clemens discloses a pump having a plurality of tubes supported along an arcuate path. There is a rotor having plural rollers which deform the tube as the rotor rotates. There is a solenoid attached to an arcuate backing member for the tubes so as to move the backing member and the tube away from the rotor in order to terminate fluid delivery through the tube.

British Pat. No. 829,329 and German Offenlegungsschrift No. 1,910,436 disclose peristaltic pumps wherein a resilient tube is sequentially deformed at plural points along its length to produce pumping action.

SUMMARY OF THE INVENTION

The preferred embodiments of the present invention which are described in more detail hereinafter include a motor driven shaft on which a generally circular cam is eccentrically mounted. In response to rotation of the shaft the outer extremity of the cam describes a circular path. Supported within the path are two or more carriers each of which has a segment of elastic tubing. The tubing is deformed in response to movement of the cam therepast and check valves within the tubing confine liquid flow therein to a single direction. The carriers are mounted for independent movement toward and away from the circular path of the cam so that the flow rate through each of the tubes is independently adjustable.

The carriers are individually mounted so that a pump embodying the invention can operate with virtually any number of channels, and the carrier for each channel can be removed for repair or replacement without disturbing any of the other channels.

An object of the invention is to provide a multichannel pump wherein the flow rate through each of the channels can be adjusted independently of all other channels. This object is achieved because each of the tube carriers is functionally independent of the other tube carriers.

Another object of the invention is to provide a multichannel pump having minimal power requirements. The present invention affords achievement of this object because the elastic pumping tubes are deformed sequentially so that sufficient power to deform only one tube at a given time is needed. Moreover, because the tubes are located so as to be deformed at substantially uniform intervals, the loading on the motor is substantially constant. Not only does this arrangement reduce the power consumption but materially enhances the longevity of the pump motor and related drive parts.

Still another object of the present invention is to provide a pump capable of pumping highly corrosive materials. It is well known that synthetic resinous materials such as Teflon are impervious to many if not most caustic substances. Teflon and like materials, however, have very little elasticity in consequence of which they can tolerate very little deformation. In one embodiment of the present invention tubing formed of such low elasticity material is supported by spaced apart resilient or flexible mounts and the cam deforms the tubing away from a straight line thus effecting the reduction in internal volume that is necessary for pumping.

The foregoing together with other objects, features and advantages will be more apparent after referring to the following specification and the accompanying drawings.

BRIEF DESCRIPTION OF THE DRAWINGS

FIG. 1 is a side elevation view of a multichannel pump embodying the present invention.

FIG. 2 is a horizontal section taken along line 2—2 of FIG. 1.

FIG. 3 is a horizontal section taken along line 3—3 of FIG. 1.

FIG. 4 is a cross section in elevation taken along line 4—4 of FIG. 3.

FIG. 5 is a fragmentary view taken along line 5—5 of FIG. 3.

FIG. 9 is a plan view of a second embodiment of the invention.

FIG. 10 is a rear view taken along line 10—10 of FIG. 9.

DETAILED DESCRIPTION OF THE PREFERRED EMBODIMENTS OF THE INVENTION

Figure 6:
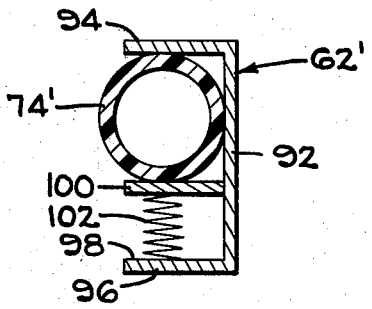
FIG. 6 is a fragmentary view showing a modification of the invention.

Referring more particularly to the drawings, reference numeral 12 identifies a base housing in which is mounted a motor 14. The motor drives a shaft 16 through a speed changing gear box 18. As can be seen most clearly in FIG. 4, shaft 16 is oriented vertically and is supported in upper and lower bearings 20 and 22, respectively, which are carried in upper and lower disc shaped supports 24 and 26.

In the space between upper and lower disc shaped supports 24 and 26 a cylindrical cam member 28 is secured to shaft 16 by means of a set screw 30. Cylindric cam 28 has a central bore eccentric of the cylindric axis thereof so that its exterior surface is eccentric of the axis of shaft 16. Supported on the exterior surface of cylindric cam 28 are upper and lower barings 32 and 34 which support for rotation relative to the cam a tube deforming roller 36. Roller 36 is composed of two frusto conical portions that radially diverge toward the axial center thereof to define a protruding central rib 38. In FIG. 4 can be seen an upstanding cylindrical wall 40 which is rigid with and symmetrical of roller 36. Secured to shaft 16 at a point above cam 28 is a fitting 42 that has a depending cylindrical wall 44 which is concentric with shaft 16 and has an inner diameter larger than the circular path described by cylindrical wall 40. Depending wall 44 extends below the upper extremity of upstanding cylindrical wall 40 so that the walls cooperate to exclude liquid from bearings 32 and 34.

Upper and lower disc shaped supports 24 and 26 are peripherally notched as indicated at 46, there being, in the embodiment shown in the drawings, eight uniformly spaced apart notches in each of the supports. The upper and lower disc shaped supports are oriented so that opposing pairs of notches are in vertical alignment in order to receive tubing support frames 48.

As can be seen in FIG. 3, each tubing support frame 48 has an essentially U-shaped cross-sectional configuration formed by a tangential base portion 50 from which extend two parallelly spaced apart radially extending side portions 52 and 54. A slot 56 is formed between the two radially extending side portions. At opposite ends of tubing support frame 48 radially extending side portions are foreshortened to form mounting tabs 58 which fit into notches 46 to secure the tubing frame to upper and lower disc shaped supports 24 and 26. Tabs 58 are provided with holes which register with threaded holes in the inner walls of notches 46 so as to accommodate a screw 60 for securing the tubing support frames to the disc shaped supports.

Mounted for radial movement within slot 56 of each tubing support frame 48 is a tube holder 62. The tube holder includes integral upper and lower tube clamps 64 and 66. As can be seen in FIG. 2, the tube clamps are formed by boring a vertically extending hole 68 and by forming a kerf 70 which extends from the hole 68 to the outer surface of the tube holder. Clamp screws 72 urge the surfaces defining kerf 70 toward one another which in turn effect a reduction in the circumference of hole 68 and clamping action on tubing inserted therein, the tubing being indicated at 74.

Disposed between tube holder 62 and tangential portion 50 of U-shaped tubing support frame 48 are compression springs 76, 77, 78 and 79 which urge the tube holder radially inward. For drawing the tube holder outward against the force of the compression springs so as to effect adjustment of the radial position thereof, there is an adjusting screw 80 which has a knurled head and a shaft threadedly engaged with a threaded passage 82 in tube holder 62. Thus, tightening adjusting screw 80 moves the tube holder outward against the force of springs 76–79. For locking the tube holder in a position established by manipulation of adjusting screw 80, upper and lower locking screws 84 and 86 are provided. The screws are threadedly engaged with threaded openings in tangential portion 50 of U-shaped support frame 48 and bear against the surface of the tube holder.

Tube 74 is supplied with upper and lower check valves, the upper one of which is indicated at 88 in FIG. 5. The check valve includes a seat forming member 92 above which a valve ball 94 is disposed. The valve ball is confined for movement adjacent the seat by a retainer 96, and seat forming member 92 is in alignment with tube clamps 64, 66 so that the seats are immovable. As can be seen in FIG. 4, check valves 88 and 90 are oriented to permit flow in an upward direction, whereby check valve 88 is an outlet check valve and check valve 90 is an inlet check valve. Tube 74 has an inlet end **75*a* and outlet end 75*b***, and the portion of the tube between the check valves constitutes a pumping chamber.

In operation, the equipment is first set up by installing as many U-shaped supports and tube holders as are needed. If it is desired to pump fluid through four channels, four such assemblies are installed by engaging screws 60 at the upper and lower extremities of the subassemblies. The inlet ends **75*a* of tubes 74 are connected to appropriate liquid supplies, and motor 14 is actuated. Thereafter each tube holder is adjusted to achieve the desired flow rate through the associated tube by moving the tube holder radially inward or outward. In adjusting the tube holder, locking screws 84 and 86 are loosened and the radial position of the tube holder is established by manipulation of screw 80. When the proper position is established, locking screws 84 and 86 are tightened so that the tube holder and tubes supported thereby are substantially rigid. When roller 36 deforms one of the tubes 74 liquid therein is expelled through the outlet check valve 88; when the roller rotates further, the elasticity of the material of which the tube is constructed causes the tube to return to its substantially straight cylindrical configuration, thus drawing liquid in through the inlet check valve 90. Each tube 74 is deformed in turn as shaft 16 and roller 36 rotate. Because only one tube is fully deformed at any given time, the load on motor 14** is substantially constant whereby the wear on the motor is significantly reduced.

Because roller 36 is supported on cam 28 by bearings 32 and 34, the roller does not abrade the individual tubes 74; rather it rolls over the tubes so that wear on the tubes is minimal.

Should one of the tube subassemblies require maintenance, the entire subassembly can be removed by removing upper and lower screws 60 without interfering with the operation of the remaining channels. Additionally, the number of channels can be varied by addition or removal of the subassemblies, the embodiment shown in the drawings accommodating up to eight channels. Obviously, more channels can be accommodated in a device having a larger diameter than that depicted in the drawings.

A modification of the invention which is particularly useful when the tubes are constructed of Teflon or like inelastic material is shown in FIG. 6. Because the modification of FIG. 6 can be employed in the apparatus of FIGS. 1–5, similar reference characters, with the addition of a prime are employed in FIG. 6. In FIG. 6 there is a tube holder 62' which includes a base portion 92 and two side portions 94 and 96; such portions define a slot 98 which has a width greater than the outside diameter of tube 74' and a depth less than the outside diameter of the tube. Tube 74' has substantially less resilience or elasticity than tube 74 described in connection with the embodiment of FIGS. 1–5. That is to say tube 74' has insufficient resilience or elasticity to return to a straight cylindrical configuration after deformation by roller 36. To achieve restoration of the tube to a substantially cylindrical shape, the modification of FIG. 6 includes a movable platen 100 which is supported in parallelism with side portions 94 and 96. Platen 100 is biased toward side portion 94 by means of one or more compression springs 102. Thus when roller 36 deforms tube 74' during the pumping stroke, platen 100 is moved downward as viewed in FIG. 6 and energy is stored in spring 102. When the roller passes the tube, the energy stored in the spring causes platen 100 to move upward to restore tube 74' to a cylindric shape as shown in FIG. 6.

Figure 7:
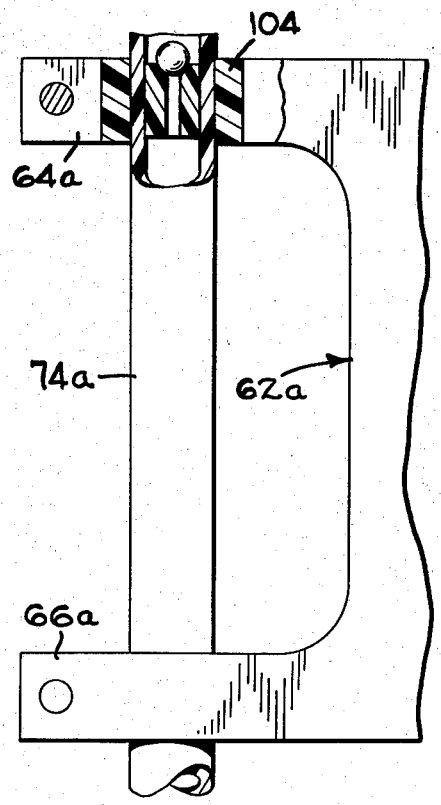
FIG. 7 is a fragmentary elevation view showing another modification of the invention.
Figure 8:
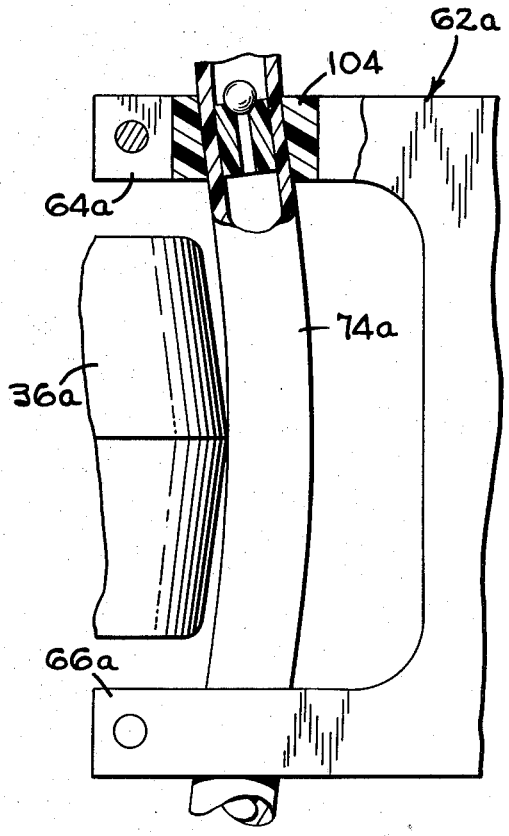
FIG. 8 is a view similar to FIG. 7 showing the apparatus in another position.

The modification shown in FIGS. 7 and 8 is also suitable when Teflon or like material of low elasticity or resilience is employed in pumping materials that would react with material having greater elasticity. In the embodiment of FIG. 7 tubing **74*a* is supported in a resilient bushing 104 in upper and lower tube clamps 64*a* and 66*a*, of a tube holder 62*a*, which are substantially identical to elements bearing corresponding reference numerals in FIGS. 1–5. Bushing 104 is formed of material that has sufficient strength to maintain the tube in a straight cylindrical position and sufficient elasticity to yield when tubing 74*a* is deformed into the arcuate position shown in FIG. 8. There is a counterpart to bushing 104 in tube clamp 66*a*. Deformation of tubing 74*a* and the bushings by roller 36*a* stores energy in the resilient bushing. When roller 36*a* moves away from contact with tube 74*a*, the energy stored in the bushings returns the tube to the straight cylindrical position shown in FIG. 7 during which movement additional liquid is drawn into the chamber through a check valve (not shown) associated with lower tube clamp 66*a*. Such is the case because the volume within th portion of tubing 74*a*** between the bushings is at a minimum when the tubing is in a straight cylindrical position.

To recapitulate, the embodiments of FIGS. 6, 7 and 8 adapt the apparatus of the invention to the pumping of materials that are reactive to the more common tubing materials such as vinyl and nylon. Teflon has excellent chemical properties in that it is inert to most substances. However, its lack of resilience and elasticity necessitates special care such as that exemplified in the embodiments of FIGS. 6–8.

In the embodiment of FIGS. 9–12 there is a flat baseplate 102 to the undersurface of which are secured rubber feet 104 to support the apparatus on a horizontal table surface or the like. Integral with baseplate 102 and extending vertically upward from one edge thereof is a support flange 106 which is provided with two spaced apart mounting holes to receive mounting screws 108 and 110. In the specific embodiment shown in the drawings, the mounting screws support two cassette-like pumping units seen most clearly in FIG. 9 at 112 and 114. As will appear from the following, the apparatus can accommodate any reasonable number of the cassette-like pumping units other than two.

Pumping unit 112 has a front plate 116 and pumping unit 114 has a front plate 118. The rear surface of front plate 118 constitutes the rear wall of pumping unit 112 and the rear wall of pumping unit 114 is formed by a back plate 120. Plates 116, 118, and 120 are retained in spaced apart relationship by spacers that extend between the plates and are fixed in place. For example, there are spacers 122 which are of tubular form and define a central bore through which a mounting screw 124 extends. There are also spacer blocks 126 which are bored to receive screws 128 therethrough. Finally, near the bottom of the vertical plates there are tubular spacers 130 which are centrally bored and retained in place by mounting screws 108 and 110. By virtue of spacers 122, 126 and 130 plates 116, 118, and 120 are retained in parallel spaced apart relation, the space between plate 116 and 118 preferably being equal to the space between plate 118 and plate 120.

An electric motor 132 is mounted to the outer surface of plate 120. Associated with the motor is a gear box 134 which has an output shaft 136 which extends through suitable openings in plates 116, 118, and 120 to project beyond the outer surface of plate 116. Secured to such projecting portion of the output shaft is a pulley 138. Spaced above shaft 136 is a driven shaft 140; shaft 140 has a portion protruding exterior of plate 116 on which is mounted a driven pulley 142. A belt 144 extends between pulleys 138 and 142 and is tensioned by a belt tensioner 146 so that when motor 132 is electrically energized, shaft 140 is rotatably driven. Secured shaft 140 between plates 116 and 118 and constituting a portion of pumping unit 112 is a circular cam 148 which is bored eccentrically of the exterior periphery thereof for mounting on shaft 140. A pin 150 fixes cam 148 to the shaft. The outer peripheral margin of cam 148 is formed by an annulus which is supported on the central body of the cam by ball bearings active on a line 151 so that the periphery of the cam rolls on, rather than rubs on, other parts to be described. The peripheral surface of the cam describes what can be characterized as an orbital path. Also mounted on shaft 140 between plates 118 and 120 is a cam 152 which is similar in configuration to cam 148 but is fixed to shaft 140 at a position angularly offset from cam 148. The amount of the angular offset between cams 148 and 152 is 90°; such amount is but an example of the general relationship of the angular offset between the cams equal to 360°/2n, where n is the number of cassette-like pumping units, n being equal to 2 in the embodiment shown in FIGS. 9–12 . The contribution of the angular offset in smoothing out the load on motor 132 will be explained subsequently. Supported in the respective cassette-like pumping units for coaction with the cams 148 and 152 is a pair of generally U-shaped tube holders, pumping unit 112 having tube holders 154 and 160. Because the tube holders are identical in construction, a description of one will suffice as a description of all. Tube holder 160 is exemplary and includes a rigid U-shaped channel formed by a base plate 162 from opposite edges of which extend two side walls 164 and 166. Each U-shaped channel is dimensioned so as to be slidably movable within the spaces defined between plates 116, 118 and 120.

As can be seen most clearly in FIG. 9, each U-shaped channel defines a tubing cavity having an open side that faces shaft 140 and the cams mounted thereon. For retaining the U-shaped body in adjustable spaced relation to the cams the lower edges of side walls 164 and 166 are formed with notches which are indicated at 168 in FIG. 12. The lower extremity of the notch forms a mouth and the inner extremity of the notch forms a seat for engagement with spacer 130; the mouth of the notch is closer to base plate 162 of the U-shaped channel than the seat so that the lower end of the tube holder is retained in fixed relation to the cams.

Spaced from notches 168 and mounted in suitable threaded openings formed in spacer blocks 126 are adjusting screws. Each screw is provided with an integral knurled head 172 which is accessible from the exterior of the respective cassette-like units so that the screws can be rotated to move the respective U-shaped members toward and away from cam 148. When screw 170 is rotated to move it away from the cams, the associated cam holder 154–160 can be removed by lifting the cam holder upward between the cam and the retracted screw until it is free of the spaced defined between plates 116, and 118, and 120. Spacers 126 and 130 (see FIG. 12) are preferably spaced on opposite sides of shaft 140 so that the U-shaped tube holder is immune to movement in response to rotation of cams 148 and 152.

Each tube holder has a pair of clamps, one of which is disposed below shaft 140 and one of which is disposed above the shaft. Each clamp has a base 174 having a rear surface retained against base plate 160 of the U-shaped channel and a front surface which defines a semi-cylindrical surface that extends parallel to the length of the U-shaped channel. A clamping body 176 has a similar semi-cylindric surface which confronts the semi-cylindric surface on base 174 so that when the two parts are drawn together by clamping screws 178 the semi-cylindrical surfaces are drawn together. At the outer extremity of clamping body 176 there is a retaining lip 179. The semi-cylindrical surfaces thus afford clamping of the ends of a flexible resilient tube 180. Tube 180 has an outer diameter when in an unstressed condition approximately equal to the space between the inner surface of side walls 164 and 166 of the U-shaped channel. In order that base 174 and clamp body 176 are wide enough to accommodate the tube diameter, side walls 164 and 166 are excised at 181. The width of base 174 and clamp body 176 is coextensive with that of the U-shaped channel. Tube 180 is formed of the same material as specified hereinabove in connection with tube 74.

Within the portions of resilient tube 180 retained by the clamps there is an inlet check valve 182 and an outlet check valve 184. The construction of the check valves is not per se novel, it being sufficient to appreciate that when the pumping chamber formed by the portion of tube 180 between the upper and lower clamps is compressed, liquid within the tube is forced out through check valve 184, and when the tubing is permitted to return to its cylindrical shape, additional fluid is drawn into the pumping chamber through check valve 182. The check valve bodies are formed in an L-shaped body having a portion that extends through an aperture 189 formed in base plate 160 so as to permit attachment an inlet tube 186 and an outlet tube 188.

Within the space between side walls 164 and 166 of the U-shaped members a rigid inelastic body 190 can be supported to avoid any war producing contact between the surfaces of cams 148 and 152 and the exterior surfaces of resilient tubes 180. Body 190 is captured between the clamps by retaining lips 179. Although body 190 is shown in the drawings as a generally cylindrical body, such shape is only exemplary. For example, a flat piece of spring steel can be employed to avoid rubbing contact between the cam surfaces and the external surfaces of tubes 180.

Figure 12:
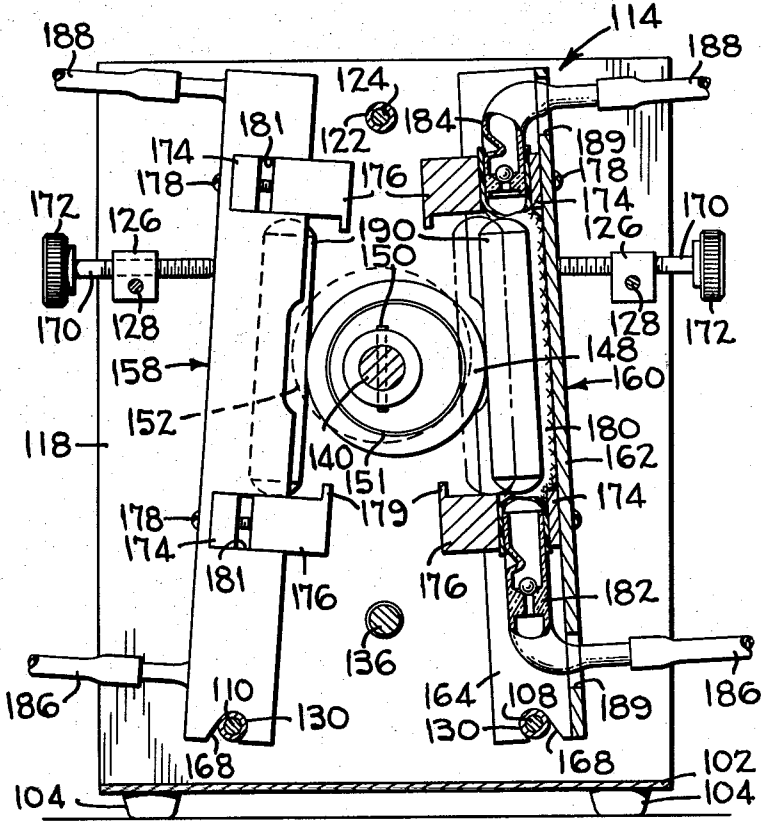
FIG. 12 is a section taken along line 12—12 of FIG. 9.
Figure 11:
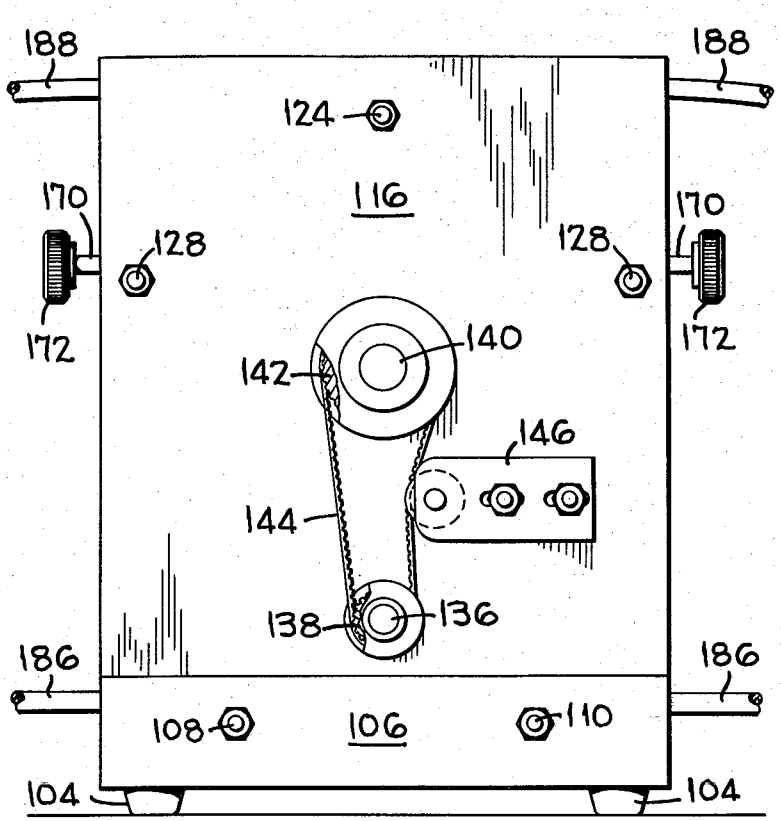
FIG. 11 is a front view taken along 11—11 of FIG. 9.

In operation the tube holders are installed as shown in FIGS. 9 and 12 and the inlet and outlet hoses 186 and 188 are connected as desired. Motor 132 is energized and each of the individual U-shaped channels can be individually adjusted by manipulation of screw 170. The adjustment of one screw associated with one pumping channel will not have any effect on the others. Because of the angular offset between cams 148 and 152, motor 132 deforms only one tube 180 at a given time so that the load on the motor is smoothed out and is relatively light. Each tube holder assembly is individually removable, in consequence of which, repair or replacement of the parts composing the same is simple. As stated above, screw 170 of a given pumping channel can be backed out, notch 168 can be disengaged from spacer 130 and the entire tube holder assembly can be removed.

If an apparatus with a greater number of pumping channels is needed, additional cassette-like pumping units can be added by providing additional plates such as plate 118 and the spacers and other parts associated therewith. In the case, for example, of a pump having three cassette-like units, an additional plate as well as an additional pair of tube holder assemblies is required. In addition, longer screws such as 124 and 128 are required and a longer motor shaft 136 and cam shaft 140 would be required. Finally, three cams, equivalent to cams 148 and 152 seen in FIG. 12, would be installed on shaft 40 with an angular offset at 60° so as to afford uniform loading on motor 132. Such enlarged pumping structure, as is the case with that specifically shown in FIGS. 9–12, provides for independent individual adjustment of the pumping rate through each of the six channels as well as the ability to replace any of the six U-shaped tube holders as may be needed.

The embodiment shown in FIGS. 9–12 can be adapted to support the relatively inelastic tubing referred to hereinabove in connection with FIGS. 6–8, because of the presence of U-shaped tube holders in the apparatus of FIGS. 9–12. In the case of the embodiment of FIGS. 7 and 8, omission of rigid body 190 is desirable.

Thus it will be seen that the present invention provides a multichannel pump wherein the flow rate through each channel can be adjusted independently, where the load on the motor is substantially constant because the tubing in each channel is deformed in sequence, and which provides for the convenient addition, deletion or replacement of one or more channels.

Although several embodiments have been shown and described it will be obvious that other adaptations and modifications can be made without departing from the spirit and scope of the invention.

What is claimed is:

1. A pump for liquids comprising a tube, said tube being elastically deformable and defining a generally linear passage in an undeformed state, an inlet check valve disposed in said passage for affording liquid flow thereinto, an outlet check valve disposed in said passage and spaced therealong from said inlet valve to define a chamber between said check valves, means for periodically deforming said tube at said chamber to effect outflow of liquid from said chamber through said outlet check valve, said deforming means retracting from said tube to permit restoration of said tube to an undeformed state and to effect inflow of liquid to said chamber through said inlet check valve, and means for adjustably positioning said tube toward and away from said deforming means so as to effect adjustment of the amount of deformation and the quantity of liquid delivered in response thereto, said positioning means including a U-shaped member having a base portion and two side portions that extend from opposite edges of said base portion and are spaced from one another to receive said tube therebetween, said U-shaped member and said tube being removable.

2. A pump according to claim 1 wherein said deforming means comprises a shaft supported for rotation on an axis substantially parallel to and spaced from said passage defined by said tube, a substantially circular cam secured to said shaft eccentric of said axis, and means for rotatively driving said shaft so that said cam moves toward and away from said tube in response to rotation of said shaft, said adjustably positioning means acting to position said tube radially of said axis to afford adjustment of the degree of deformation of said tube and of the pumping rate of said pump.

3. A pump according to claim 2 including a second elastically deformable tube, said second tube defining a second generally linear passage in an undeformed state in substantial parallelism with first said passage, a second inlet check valve disposed in said second passage for affording liquid flow thereinto, a second outlet check valve disposed in said second passage and spaced therealong from said second inlet check valve to define a second chamber between said second inlet and outlet check valves, means for supporting said second tube in substantial parallelism with first said tube and in circumferentially spaced apart relation thereto so that first said tube and said second tube are sequentially deformed in response to rotation of said cam, and second positioning means independent of first said adjustably positioning means for adjustably positioning said second tube radially of said axis to afford adjustment of the pumping rate of said second tube independently of the pumping rate of said first tube, said second positioning means including a second U-shaped member having a base portion and two side portions that extend from opposite edges of said base portion and are spaced from one another to receive said second tube therebetween, said second U-shaped member and said second tube being removable independently of first said U-shaped member and tube.

4. A pump according to claim 1 including a first spacer supported in parallel spaced apart relation to said deforming means, said U-shaped member having means forming a notch engagable with said first spacer for affording pivotal of said U-shaped member about said first spacer, a second spacer remote from said first spacer and said deforming means, means carried by said second spacer and adjustable relative thereto for coacting with a portion of said U-shaped member remote from said notch to effect adjustable movement a said U-shaped member toward and away from said deforming means, said notch being disengagable with said first spacer and said coacting means being retractable from said deforming means to afford removal of said U-shaped member.

5. A multichannel pump comprising upper and lower members having respective upper and lower bearings centrally thereof, said upper and lower members having substantially circular peripheries concentric with said bearings, a shaft supported in said bearings and extending between said members, means for rotatively driving said shaft, an eccentric roller mounted on said shaft and describing an orbital path in response to rotation of said shaft and at least two tubing assemblies supported between said upper and lower members and spanning the space therebetween in substantial parallelism to said shaft, each said tubing assemblies including an elastically deformable tube defining a generally linear passage in an undeformed state, a U-shaped member having a base portion and two side portions that extend from opposite edges of said base portion and are spaced from one another to define a slot for supporting the tube in substantial parallelism to the axis of said shaft, an inlet check valve disposed in said tube for affording liquid flow thereinto, an outlet check valve disposed in said tube and spaced therealong from said inlet tube to define a chamber between said check valves, said tube being positioned so that said chamber has a portion in said orbital path, and means for adjustably positioning said chamber toward and away from said eccentric roller so as to be deformed periodically in response to rotation of said shaft, each said U-shaped member being independently removable.

6. A pump according to claim 5 wherein each said tubing assembly includes a tube holder having upper and lower clamp portions for circumscribing said tube at upper and lower spaced apart locations, upper and lower flexible resilient bushings mounting said tube within said clamp members, said bushings normally biasing said tubing in a linear cylindrical configuration and being resiliently yieldable to permit said tubing to be deformed into an arcuate shape in response to movement of said eccentric cam therepast.

7. A pump according to claim 5 wherein each said tubing assembly includes a tube holder having a rigid member forming a U-shaped channel which has a depth less than the outer diameter of said tubing and a width greater than the outside diameter of the tubing, said elastically deformable tube being disposed in said channel, a planar platen disposed in said channel and bearing against a surface of said tubing, means for resiliently and yieldably biasing said platen against said tube to urge said tube into a cylindric shape, said biasing means permitting deformation of said tube to a generally flattened condition in response to movement of said eccentric roller therepast, said biasing means restoring said tube to a substantially cylindrical cross-sectional shape in absence of said eccentric cam.

8. A pump according to claim 5 wherein each said tubing assembly includes a tubing support frame spanning the space between said upper and lower members, means for removably securing said tubing support frame to said upper and lower members, a tube holder having a length less than the space between said upper and lower members, means for mounting said tube holder to said tubing support frame between said tubing support frame and said orbital path, said mounting means affording adjustable movement of said tube holder toward and away from said orbital path, said tube holder including upper and lower tubing clamps for clamping said elastically deformable tube therein, said outlet and inlet check valves being confined by respective said upper and lower clamps so that said chamber is disposed between said clamps and within said orbital path.

9. A pump according to claim 8 wherein said tube holder mounting means comprises means for resiliently biasing said tube holder inward of said tubing support frame toward said orbital path, and means for controllably drawing said tube holder toward said tubing support frame away from said path and against said biasing means.

10. A pump according to claim 9 wherein said tube holder drawing means comprises a threaded hole formed in said tube holder and oriented radially outward of said shaft, a clearance hole formed in said tubing support frame in alignment with said threaded hole, and a headed screw having a threaded shaft extending through said clearance hole into threaded engagement with said threaded hole and a head accessible exteriorly of said tubing support frame.

11. A pump according to claim 10 wherein said tubing support frame is formed with upper and lower openings between the upper and lower extremities of said tube holder and respective said upper and lower members, said openings having a size to afford passage of said elastically deformable tube therethrough, and upper and lower tube extensions integral with said elastically deformable tube and extending through respective said openings.

12. A multichannel pump comprising first and second rigid planar plates, means for supporting the plates in parallel spaced apart relation to define a space therebetween, said supporting means including at least a pair of first spaced apart spacers and a pair of second spaced apart spacers spanning the space between said plates, a shaft transpiercing said plates and spanning said space at a site between the spacers of respective said pairs of spacers, an eccentric cam secured to said shaft within said space so that upon rotation of said shaft the periphery of said cam defines an orbital path within said space, a first U-shaped tube holder disposed in said space and supported by said first spacers for movement toward and away said orbital path, a second U-shaped tube holder disposed in such space and supported by said second spacers for movement toward and away from said orbital path, each said U-shaped tube-holder having disposed therein a flexible resilient tube and an inlet and outlet check valve mounted in said tube in spaced apart relation so that a portion of said tube intermediate said check valves resides in said orbital path, and means for rotatively driving said shaft.

13. A multichannel pump according to claim 12 including at least one additional rigid planar plate, means for supporting said additional plate in parallel spaced apart relation to said second plate to define a second space, said shaft extending through said second space, a second eccentric cam mounted on said shaft within said second spaced, said supporting means including third and fourth pairs of spacers spanning said second space, the spacers of said third and fourth pairs being disposed on opposite sides of said second cam, third and fourth U-shaped tube holders disposed in said second space and supported by respective said third and fourth spacer pairs for movement toward and away said second cam, said third and fourth U-shaped tube holders each having disposed therein a flexible resilient tube and an inlet and outlet check valve mounted in each said tube in spaced apart relations so that a portion of each said tube intermediate said check valves resides in the path of said second cam, and means for independently positioning said third and fourth tube-holders toward and away from said second cam, said second cam being angularly offset from first said cam so that the flexible resilient tubes in said U-shaped tube holders are sequentially deformed in response to rotation of said shaft.

14. A multichannel pump according to claim 13 wherein the amount of angular offset between said cams is 360°/2n, wherein n is equal to the number of spaces defined between said rigid planar plates.

* * * * *